US010290971B2

(12) United States Patent
Oishi et al.

(10) Patent No.: US 10,290,971 B2
(45) Date of Patent: May 14, 2019

(54) CONNECTOR FITTING DETECTION STRUCTURE AND CONNECTOR

(71) Applicants: YAZAKI CORPORATION, Tokyo (JP); HONDA MOTOR CO., LTD., Tokyo (JP)

(72) Inventors: Kozo Oishi, Tochigi (JP); Tomoyuki Miyakawa, Tochigi (JP); Kazuyuki Ochiai, Saitama (JP); Daisuke Fujihira, Saitama (JP); Shintaro Matsuda, Saitama (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/211,168

(22) Filed: Dec. 5, 2018

(65) Prior Publication Data

US 2019/0109413 A1 Apr. 11, 2019

Related U.S. Application Data

(63) Continuation of application No. PCT/JP2017/024710, filed on Jul. 5, 2017.

(30) Foreign Application Priority Data

Jul. 8, 2016 (JP) ..... 2016-136323

(51) Int. Cl.
*H01R 13/434* (2006.01)
*H01R 13/627* (2006.01)
*H01R 13/15* (2006.01)

(52) U.S. Cl.
CPC ..... *H01R 13/6272* (2013.01); *H01R 13/15* (2013.01)

(58) Field of Classification Search
CPC .. H01R 13/434; H01R 13/113; H01R 13/432; H01R 13/18; H01R 13/64
(Continued)

(56) References Cited

U.S. PATENT DOCUMENTS 4,973,859 A * 11/1990 Shodai ..... B60R 21/0176 280/735
5,559,672 A * 9/1996 Buras, Jr. ..... G06F 1/1616 361/679.32

(Continued)

FOREIGN PATENT DOCUMENTS

JP 5-15352 U 2/1993
JP 7-7682 B2 1/1995

(Continued)

OTHER PUBLICATIONS

International Search Report and Written Opinion of the International Search Report for PCT/JP2017/024710 dated Aug. 15, 2017.

(Continued)

*Primary Examiner* — Phuong Chi T Nguyen
(74) *Attorney, Agent, or Firm* — Kenealy Vaidya LLP

(57) ABSTRACT

One of a pair of first terminals includes a spring member of which one end is supported by the first housing. A contact portion that contacts one of a pair of second terminals is formed on a free end of the spring member. A lock arm abuts against the spring member to displace the contact portion, and brings the contact portion into contact with one of the second terminals at the time of locking. The other of the first terminals has a contact portion that contacts the other of the second terminals when the connectors are fitted, and is disposed apart from one of the first terminals.

4 Claims, 6 Drawing Sheets

(58) Field of Classification Search
USPC ..... 439/745, 871, 744, 872, 873, 748
See application file for complete search history.

(56) References Cited

U.S. PATENT DOCUMENTS

| | | | | |
|---|---|---|---|---|
| 5,562,486 | A * | 10/1996 | Saijo | H01R 13/4362 439/188 |
| 7,402,071 | B2 * | 7/2008 | Ohtaka | H01R 13/6275 439/357 |
| 9,478,895 | B2 * | 10/2016 | Lappoehn | H01R 13/6272 |

FOREIGN PATENT DOCUMENTS

| | | | |
|---|---|---|---|
| JP | 2001-196134 | A | 7/2001 |
| JP | 2015-26510 | A | 2/2015 |

OTHER PUBLICATIONS

International Preliminary Report on Patentability and English language Written Opinion of the International Search Report for PCT/JP2017/024710 dated Jan. 8, 2019.

* cited by examiner

CONNECTOR FITTING DETECTION STRUCTURE AND CONNECTOR

CROSS-REFERENCES TO RELATED APPLICATION(S)

This application is a continuation PCT application No. PCT/JP2017/024710, which was filed on Jul. 5, 2017 based on Japanese Patent Application (No. 2016-136323) filed on Jul. 8, 2016, the entire contents of which are incorporated herein by reference.

TECHNICAL FIELD

The present invention relates to a connector fitting detection structure and a connector.

BACKGROUND ART

Conventionally, a fitting detection structure of a connector having a first housing and a second housing which are formed to be fitted to each other is known. A detection terminal having a pair of contact portions is supported by the first housing in conjunction with the fitting operation, and a pair of mating terminals electrically connectable to the pair of contact portions of the detection terminals are supported by a second housing (See, for example, Patent Document 1).

In the fitting detection structure, when the pair of mating terminals are brought into contact with the pair of contact portions of the detection terminal and guided in a case that the both housings are fitted, a detection circuit connected to the pair of mating terminals outputs a detection signal to detect that both housings have reached the mated state.

PRIOR ART DOCUMENT

Patent Literature

[PTL 1]
Japanese Patent Application Publication No. 2015-26510

SUMMARY OF INVENTION

Technical Problem

However, in the fitting detection structure of Patent Document 1, the pair of contact portions of the detection terminal is formed by bifurcating the same conductor. Therefore, when the distance between the pair of contact portions is set to be short, the distance between the pair of mating terminals is also set to be short. As a result, when water drops or the like enter between the pair of mating terminals, the pair of mating terminals are short-circuited through the water droplets. Therefore, the fitting of the two housings may be erroneously detected even though the housings are not in the fitted state.

The present invention has been made in view of the above circumstances, and an object thereof is to improve the reliability of fitting detection of a connector.

Solution to Problem

In order to achieve the aforementioned object, the "connector fitting detection structure" according to the present invention is characterized by the following configurations (1) to (3).

(1) A connector fitting detection structure comprising:

a pair of connectors formed to be capable of fitting to each other, one connecter of the pair of connectors including:

a first housing;

a lock arm which is elastically deformed and supported by the first housing;

a locked portion provided in the lock arm; and a pair of first terminals supported by the first housing in a state that the terminals are electrically connected to each other, the other connector of the pair of connectors including:

a second housing;

a lock portion provided in the second housing; and a pair of second terminals supported by the second housing, wherein when the pair of connectors are fitted, the locked portion of the one connector is moved over the lock portion of the other connector and engaged with the lock portion thereof, the pair of first terminals and the pair of second terminals are arranged at positions electrically connectable to each other when the pair of connectors are fitted, when conduction between the pair of second terminals is detected by the pair of first terminals, it is detected that the pair of connectors are fitted, one of the pair of first terminals has a spring member, one end of the spring member is a fixed end supported by the first housing, and the other end thereof is a free end in which a contact portion is formed so as to come into contact with one of the pair of second terminals, the other of the pair of first terminals is arranged to come into contact with the other of the pair of second terminals and to be separated from the one of the pair of first terminals when the pair of connectors are fitted, and the lock arm is configured such that when the locked portion is moved over the lock portion, the lock arm is displaced to abut on the spring member, and the contact portion is displaced in a direction away from the one of the pair of second terminals, and when the locked portion is engaged with the lock portion over the lock portion, the contact portion comes into contact with the one of the pair of second terminals.

(2) The connector fitting detection structure according to the aforementioned configuration (1), wherein the pair of first terminals are electrically connected to each other by an electric wire.

(3) The connector fitting detection structure according to the aforementioned configuration (1) or (2), wherein the first housing has a first tubular portion which holds the other of the pair of first terminals therein, the second housing has a second tubular portion which holds the other of the pair of second terminals therein and into which the first tubular portion is inserted, and an annular elastic member is arranged in an outer peripheral surface of the first tubular portion so as to seal a gap between the outer peripheral surface of the first tubular portion and an inner peripheral surface of the second tubular portion.

According to the connector fitting detection structure of the above configuration (1), since the pair of first terminals are arranged at positions separated from each other of in the first housing, the pair of second terminals can be positioned apart from each other. Accordingly, even if a water droplet or the like enters between the pair of second terminals, the occurrence of a short circuit between the second terminals can be suppressed, and thus the reliability of the fitting detection of the connector can be improved.

Further, one of the first terminals is configured so that the contact portion is brought into contact with the second terminal by the displacement of the lock arm when the locked portion of the lock arm of the first housing is engaged over the lock portion of the second housing in case that the housings are fitted. Therefore, at the timing at which the two housings are fitted, one of the first terminals can be brought into contact with one of the second terminals, and thereby the fitting detection accuracy of the connector can be improved.

Here, the pair of first terminals are preferably electrically connected to each other by an electric wire. Therefore, according to the connector fitting detection structure having the above configuration (2), it is possible to conduct a simple operation only by connecting the pair of first terminals by one electric wire, and to reduce the component cost, thereby reducing the manufacturing cost. In addition, since the pair of first terminals can be easily conducted regardless of the arrangement of the first terminals and the distance between the first terminals, the degree of freedom in designing the connector can be improved.

Preferably, the first housing includes a first tubular portion that holds the other of the first terminals therein, and the second housing includes a second tubular portion which holds the other of the second terminals therein and into which the first tubular portion is inserted. In an outer peripheral surface of the first tubular portion, an annular elastic member may be arranged so as to seal a gap between the outer peripheral surface of the first tubular portion and the inner peripheral surface of the second tubular portion. Therefore, according to the connector fitting detection structure of the above configuration (3), it is possible to prevent the other of the second terminals from being hydrated by water outside the connector when the housings are fitted. Further, since the creepage distance between the pair of second terminals can be increased, the occurrence of a short circuit between the pair of second terminals can be reliably prevented, and thereby the reliability of the fitting detection of the connector can be further improved.

Further, in order to achieve the above object, the "connector" according to the present invention is characterized by the following configuration (4).

(4) A connector comprising:

a housing formed to be capable fitting with a mating housing; and a pair of terminals which are supported by the housing in a state that the pair of terminals are electrically connected to each other and are electrically connected to a pair of detection terminals supported by the mating housing when the housing is fitted to the mating housing, wherein the housing is configured such that a locked portion provided in a lock arm elastically deformable supported by the housing is moved over a lock portion provided in the mating housing and engaged with the lock portion when the housing is fitted to the mating housing, one of the pair of terminals has a spring member, one end of the spring member is a fixed end supported by the housing, and the other end thereof is a free end in which a contact portion is formed so as to come into contact with one of the pair of detection terminals, the other of the pair of terminals is arranged to come into contact with the other of the pair of detection terminals and to be separated from the one of the pair of terminals when the housing is fitted to the mating housing, and the lock arm is configured such that when the locked portion is moved over the lock portion, the lock arm is displaced to abut on the spring member, and the contact portion is displaced in a direction away from the one of the pair of detection terminals, and when the locked portion is engaged with the lock portion over the lock portion, the contact portion comes into contact with the one of the pair of detection terminals.

According to the connector having the configuration (4), since the pair of terminals are arranged at positions separated from each other in the housing, the pair of detection terminals can be positioned apart from each other. Thus, even if water drops or the like enter between the pair of detection terminals, the occurrence of a short circuit between the detection terminals can be suppressed, and thus the reliability of the fitting detection of the connector can be improved.

Further, one of the pair of terminals is configured such that the contact portion is brought into contact with the detection terminal by the displacement of the lock arm when the locked portion of the lock arm of the housing is engaged over the lock portion of the mating housing in case that the housings are fitted. Therefore, at the timing when the two housings are fitted, one of the terminals can be brought into contact with one of the detection terminals, and thereby the fitting detection accuracy of the connector can be improved.

Advantageous Effects of Invention

According to the present invention, the reliability of the fitting detection of the connector can be improved.

DESCRIPTION OF EMBODIMENTS

Figure 1:
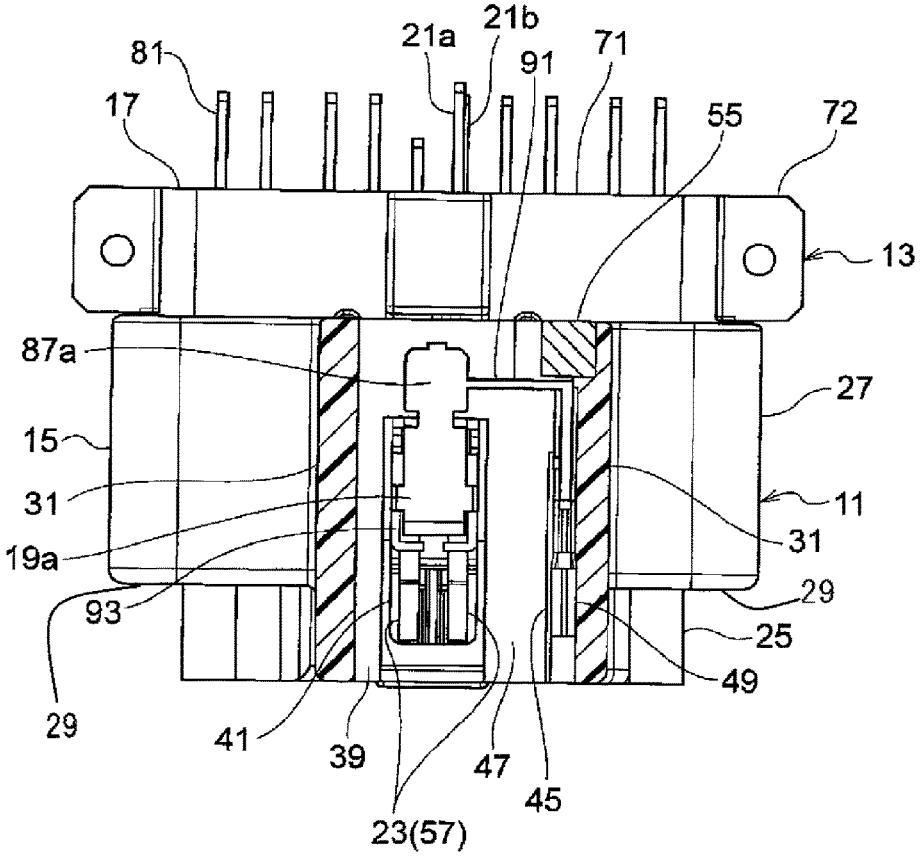
FIG. 1 is a top view showing in a cross-section a part of a connector to which a fitting detection structure according to the present invention is applied.

An embodiment of a connecter fitting detection structure according to the present invention will be described below with reference to FIGS. 1 to 6.

As shown in FIGS. 1 to 4, the connector fitting detection structure of the embodiment of the present invention includes a first housing 15 and a second housing 17 which are formed to be capable of fitting to each other and constructs a pair of connectors 11 and 13, a pair of first terminals 19*a* and 19*b* supported by the first housing 15, a pair of second terminals (detection terminals) 21*a* and 21*b* supported by the second housing 17, and a lock arm 23 cantilevered by the first housing 15. The pair of first terminals 19*a* and 19*b* and the pair of second terminals 21*a* and 21*b* are provided at positions electrically connectable to each other when both the housings 15 and 17 are properly fitted (Hereinafter, referred to as "fitting"). The fitting directions of both the housings 15 and 17 will be described as a front below.

Figure 3:
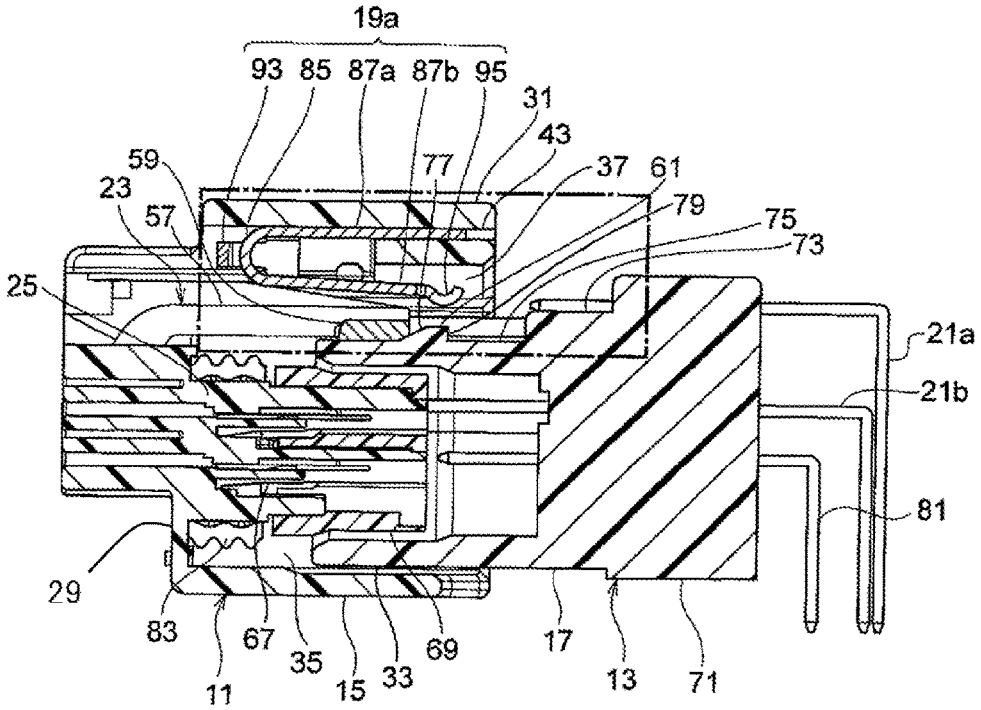
FIG. 3 is a sectional view before fitting in the direction of arrow A-A of FIG. 2.

As shown in FIG. 3, the first housing 15 is made of synthetic resin, and includes a housing main body 25 (first tubular portion) formed in a square tubular shape, an outer tubular portion 27 surrounding the housing main body 25, a coupling portion 29 connecting the housing main body 25 and the outer tubular portion 27, and a bulging portion 31 protruding upward from the outer tubular portion 27. A fitting space 35 into which the hood portion 33 of the second housing 17 is inserted is formed to be open forward between the housing main body 25 and the outer tubular portion 27. The housing main body 25 is formed to protrude rearward from the coupling portion 29.

Figure 2:
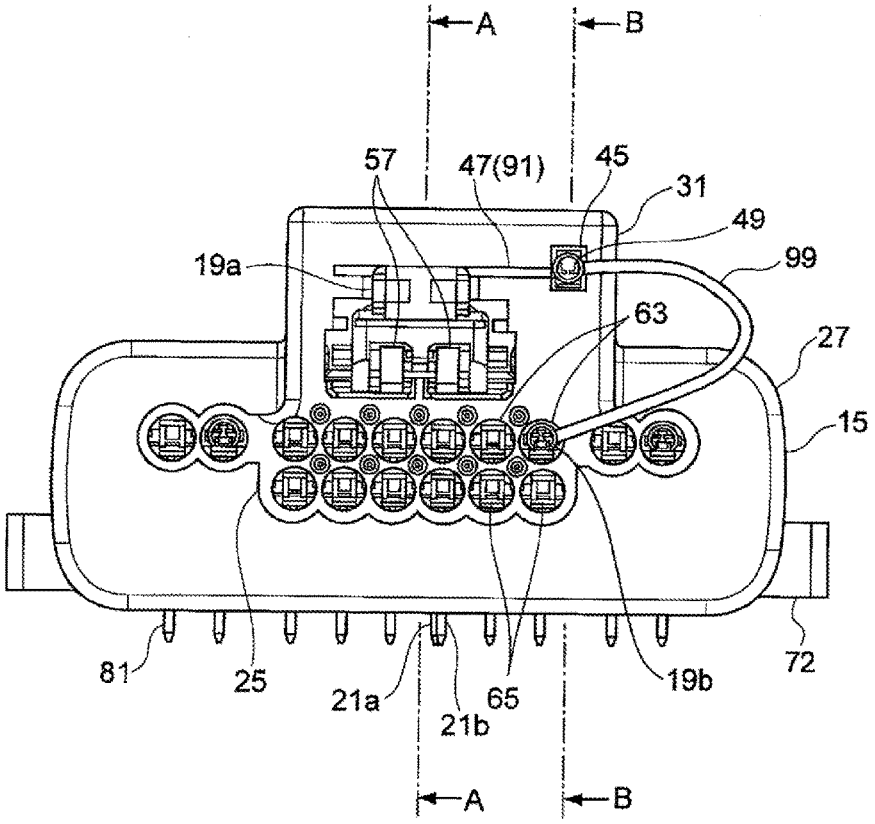
FIG. 2 is a rear view of the connector of FIG. 1 as viewed from behind a first connector.

As shown in FIGS. 1 and 3, the bulging portion 31 is provided continuously in the front-rear direction so as to protrude upward from the housing main body 25 and the outer tubular portion 27. An operating space 37 penetrates in the front-rear direction so as to receive one first terminal 19*a* of the pair of first terminals. As shown in FIG. 1, in a bottom portion of the bulging portion 31, a window portion 41 is formed by cutting out a part of the upper wall 39 of the outer tubular portion 27 defining the operating space 37. The lock arm 23 is visible through the window portion 41 and a pressing operation of the one first terminal 19*a* is enabled. As shown in FIG. 3, an engaging groove 43 extending in the front-rear direction is formed on an inner wall of the bulging portion 31, and the one first terminal 19*a* inserted into the operating space can be engaged with the engaging groove 43. As shown in FIGS. 1 and 2, a first cavity 45 is formed in the bulging portion 31 at a position spaced apart from the operating space 37 in the width direction of the first housing 15, and the first cavity 45 and the operating space 37 are formed so as to be continuous with each other via a slit portion 47 opened rearward of the bulging portion 31 along the upper wall 39.

Figure 4:
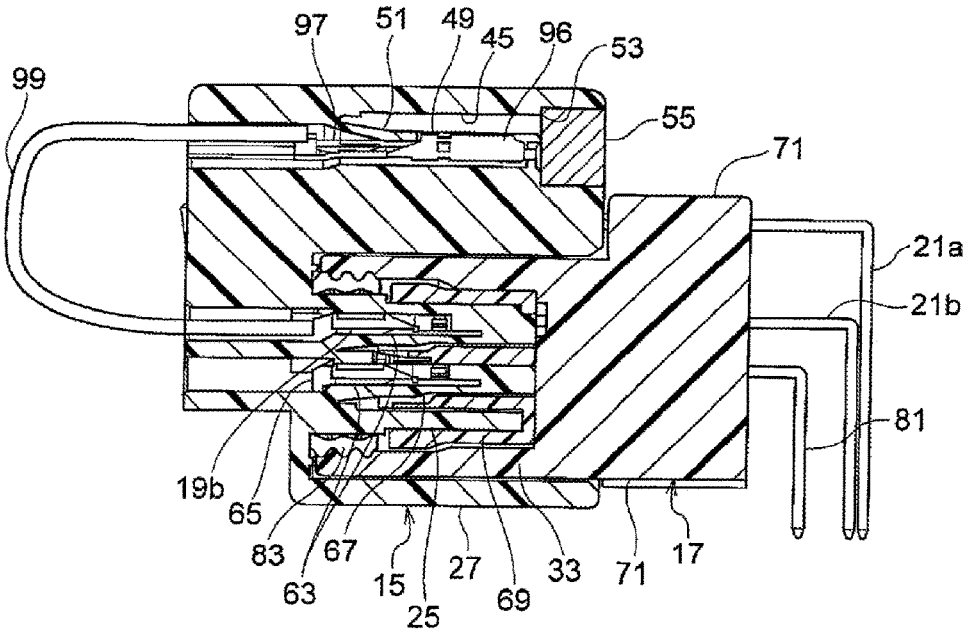
FIG. 4 is a sectional view after fitting in the direction of arrow B-B of FIG. 2.
Figure 5:
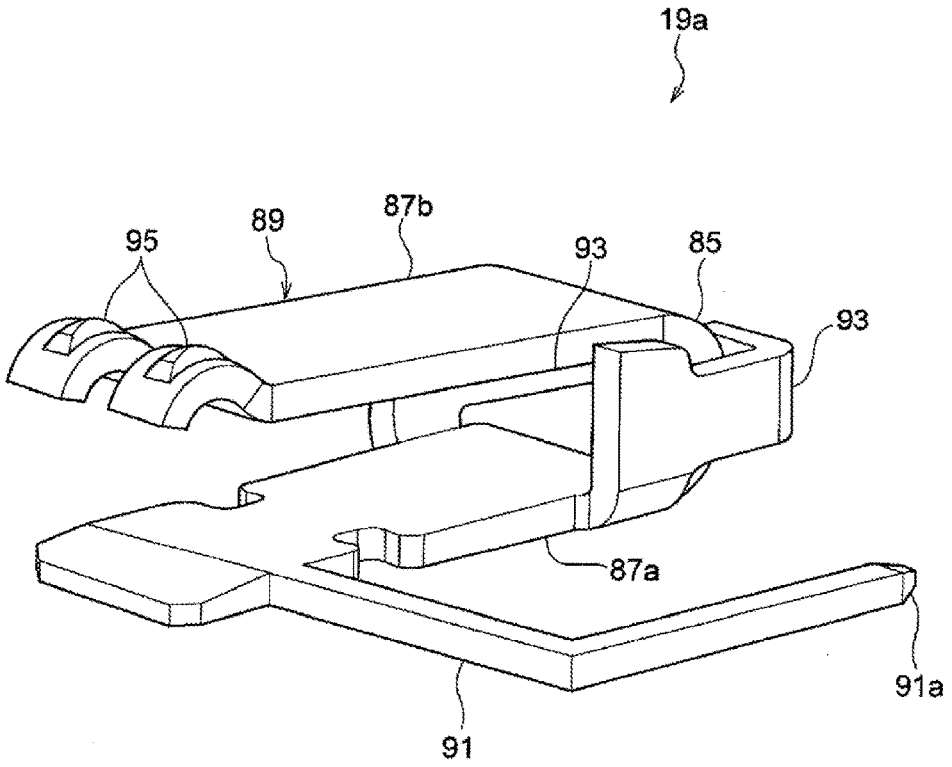
FIG. 5 is an external perspective view of one first terminal.

The first cavity 45 has a rectangular cross section, and a female terminal 49 for connecting an electric wire to the one first terminal 19*a* can be inserted from behind. As shown in FIG. 4, a deflectable locking lance 51 is provided on an inner wall of the first cavity 45, and the female terminal 49 accommodated in the first cavity 45 is locked in a normal position to restrict the backward movement. A through hole 53 having a rectangular cross section is opened in front of the first cavity 45 by a mold passed during molding, and the through hole 53 is sealed by a block-shaped sealing member 55.

A lock arm 23 is cantilevered on the upper surface of the housing main body 25 protruding rearward from the coupling portion 29. As shown in FIGS. 1 and 2, the lock arm 23 has a pair of arm bodies 57 that vertically extend from the upper surface of the housing main body 25 so as to be elastically deformable forward, and a locked portion 59 that connects front end portions of the arm bodies 57. The locked portion 59 of the lock arm 23 is disposed in the fitting space 35 into which the hood portion 33 of the second housing 17 is inserted. When both the housings 15 and 17 are fitted, as shown in FIG. 3, the locked portion 59 is engaged over the lock portion 61 protruding from the hood portion 33 described later so as to maintain the fitted state of both the housings 15 and 17.

A plurality of second cavities 63 are formed in the housing main body 25 so as to penetrate in the front-rear direction. As shown in FIG. 2, each second cavity 63 has a circular cross section and is arranged in two rows in the height direction, and a female terminal 65 is inserted into the second cavity 63 from behind. Similarly to the first cavity 45, the inner wall of the second cavity 63 is provided with a lance 67 that locks the female terminal 65 accommodated therein at a normal position and restricts the female terminal 65 from coming off rearward. The front holder 69 is attached to the housing main body 25 from the front, and thereby deflection of the lance 67 is regulated. For this reason, the locking of the female terminal 65 by the lance 67 is further ensured. In the present embodiment, among the plurality of female terminals 65, the female terminal 65 inserted into one place in the upper stage of the second cavity 63 serves as the other first terminal 19*b*. In the following, the other first terminal 19*b* is described as distinguished from the female terminal 65.

As shown in FIG. 3, the second housing 17 is made of a synthetic resin, and includes a block-shaped base 71, a rectangular tubular hood portion 33 (second tubular portion) projecting forward from the base 71, and an attachment portion 72 extending in a plate shape in the width direction of the base 71. The housing body 25 of the first housing 15 can be inserted into the hood portion 33. A stepped portion 73 is formed in the base portion 71, and one second terminal 21*a* of the second terminals connected to the one first terminal 19*a* is mounted (held) in the stepped portion 73 in a penetration state. On the upper surface of the upper wall 75 of the hood portion 33, a protruding lock portion 61 is formed to protrude. An inclined surface 77 is formed on the front surface of the lock portion 61, and a slope engagement surface 79 with a gradient nearly vertical is formed on the rear surface thereof. The one second terminal 21*a* held to the step portion 73 is disposed behind the lock portion 61 and is disposed above the upper surface of the lock portion 61.

Inside the hood portion 33, a plurality of male terminals 81 are arranged in a penetrating state, and each of the male terminals 81 is attached (held) to the base portion 71. These male terminals 81 are formed by bending a base end portion exposed from the base portion 71 in an L-shape, and the tip end portion inserted into the second cavity 63 of the first housing 15 is electrically connected to the female terminal 65 held in the second cavity during the fitting of both the housings 15 and 17. In the present embodiment, among these male terminals 81, the male terminal 81 connected to one of the first terminals 19*a* accommodated in the second cavity 63 is the other second terminal 21*b*. Hereinafter, the second terminal 21*b* is distinguished from the male terminal 81.

Similarly to the male terminal 81, the pair of second terminals 21*a* and 21*b* held in the second housing 17 is formed by bending the base end portion in an L-shape, and the tip end of the base end portion is connected to a detection circuit formed on a substrate (not shown).

As shown in FIG. 3, an annular elastic member 83 is attached to an outer peripheral surface of the housing main body 25 of the first housing 15. The annular member 83 is made of synthetic rubber, and an inner peripheral surface and an outer peripheral surface thereof is formed in a cross-sectional wave shape. The annular member 83 is disposed such that the rear end comes in contact with the front surface of the coupling portion 29. Further, the annular member 83 closely adheres to the inner peripheral surface of the hood portion 33 of the second housing 17 when the housings 15 and 17 are fitted. Thereby the gap between the outer peripheral surface of the housing main body 25 and the inner peripheral surface of the hood portion 33 is sealed in a watertight manner.

Next, the one first terminal 19*a* will be described in detail. The one first terminal 19*a* is formed by pressing a metal plate material, and includes a spring member 89 formed by extending a first piece 87*a* and a second piece 87*b* forward from both ends of the U-shaped curved portion 85, a connecting portion 91 extending in L-shape from the front end portion of the first piece 87*a* of the spring member 89, and a grip portion 93 extending from the rear end portion of the first piece 87*a* of the spring member 89. The spring member 89 is provided with the first piece 87*a* and the second piece 87*b* facing each other. In the tip end portion of the second piece 87*b*, a contact portion 95 that bulges outward (opposite to the first piece 87*a*) and contacts with the one second terminals 21*a* is arranged. The contact portion 95 is bifurcated and provided in parallel in the width direction. The connecting portion 91 extends in the width direction from the front end portion of the first piece 87*a* and is bent rearward with a substantially perpendicularly. The connecting portion 91 has substantially the same thickness as the first piece portion 87*a* and is disposed on the same plane as the first piece portion 87*a*. The rear end portion 91*a* can be connected to the female terminal 49 housed in the first cavity 45 with a tapered inclined surface. The grip portion 93 has a bilaterally symmetrical shape vertically extending from both side surfaces of the rear end portion of the first piece portion 87*a* and extending in an L shape rearward of the curved portion 85, and is a portion that is pinched by a finger when the one first terminal 19*a* is inserted into the operating space 37.

When the one first terminal 19*a* is inserted into the operating space 37 from behind the bulging portion 31, the first piece portion 87*a* as one end of the spring member 89 slides on the engaging groove 43 of the inner wall of the bulging portion 31, and then is engages with the engaging grooves 43. Furthermore, the connecting portion 91 extending from the spring member 89 slides on the slit portion 47 of the bulging portion 31, and then is engaged with the slit portion 47. Thereby, the connecting portion 91 is supported by the first housing 15.

As shown in FIG. 3, in the one first terminal 19*a* supported by the first housing 15, the second piece 87*b* as a free end is disposed in the operating space 37 below the first piece 87*a*, and the contact portion 95 protruding downward from the second piece 87*b* is disposed in a path into which the one second terminal 21*a* in the operating space 37 enters. Below the second piece 87*b*, both arm bodies 57 of the lock arm 23 are disposed outside the operating space 37 via the window portion 41.

The lock arm 23 is displaceable in a direction intersecting an approach direction of the lock portion 61. Due to the displacement when the locked portion 59 is moved over the lock portion 61, both the arm bodies 57 are entered into the operating space 37 through the window portion 41 and then abuts on the second piece 87*b* of the one first terminal 19*a*, and thereby the contact portion 95 is moved in a direction away from the one second terminal 21*a*. Further, the lock arm 23 is formed such that when the two housings 15 and 17 are fitted, the locked portion 59 is engaged over the lock portion 61, at this time, both the arm bodies 57 are elastically restored, and the contact portion 95 comes into contact with the one second terminal 21*a*.

When the one first terminal 19*a* is held in the first housing 15, as shown in FIG. 1, the connecting portion 91 of the one first terminal 19*a* is disposed in the first cavity 45 and is electrically connected to the female terminal 49 accommodated in the first cavity 45. A known female terminal can be used for the female terminal 49. As shown in FIG. 4, the female terminal 49 has a terminal connection portion 96 including a contact part (not shown) which elastically contacts with the tip end portion 91*a* of the connecting portion 91 of the first terminal 19*a*, and a wire crimping portion 97 for crimping the electric wire 99 described later. After the first terminal 19*a* is assembled to the first housing 15, the female terminal 49 is inserted into the first cavity 45 from behind and locked by the lance 51. Thereby, the connection state with the connecting portion 91 is maintained.

The other first terminal 19*b* held in the second cavity 63 may use a known female terminal, for example, the female terminal 65 housed in another second cavity 63. That is, the other first terminal 19*b* has a contact portion (not shown) described below in which an electric wire 99 is crimped and connected, and where the other second terminal 21*b* contacts when both the housings 15 and 17 are fitted.

As shown in FIGS. 2 and 4, both ends of the electric wire 99 are connected to the pair of first terminals 19*a* and 19*b* held in the first housing 15, respectively. One end of the electric wire 99 is crimped to the wire crimping portion 97 of the one first terminal 19*a* held in the first cavity 45 and pulled out from the first cavity 45. Further, the other end thereof is crimped to the other first terminal 19*b* accommodated in the second cavity 63 and pulled out from the second cavity 63. Thus, the pair of first terminals 19*a* and 19*b* are electrically connected to each other via one electric wire 99. Also, the gap between each of the cavities 45 and 63 and the electric wire 99 can be tightly sealed by a known seal member.

In such configuration, when the two housings 15 and 17 are fitted and the pair of second terminals 21*a* and 21*b* are respectively connected to the pair of first terminals 19*a* and 19*b*, the pair of second terminals 21*a* and 21*b* are short-circuited to each other via the pair of first terminals 19*a* and 19*b* connected by the electric wire 99. At this time, the detection circuit connected to the pair of second terminals 21*a* and 21*b* outputs a detection signal when the pair of second terminals 21*a* and 21*b* are conducted. With the presence or absence of the output of the detection signal, it is detected that both the housings 15 and 17 have reached the fitted state.

Next, the operation of this embodiment will be described. First, both housings 15 and 17 are opposed to each other, and both housings 15, 17 are fitted to each other. In a fitting process of the housings 15 and 17, as shown in FIG. 6A, the hood portion 33 of the second housing 17 is inserted into the fitting space 35 between the housing main body 25 of the first housing 15 and the outer tubular portion 27. At this time, the locked portion 59 of the lock arm 23 disposed in the fitting space 35 is in a natural state extending substantially in the front-rear direction.

Figure 6B:
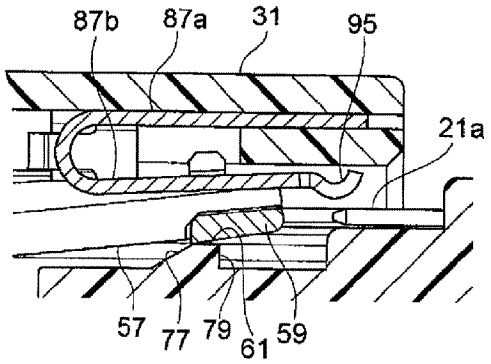
FIGS. 6A to 6C are operation diagrams within the frame of FIG. 3.
Figure 6A:
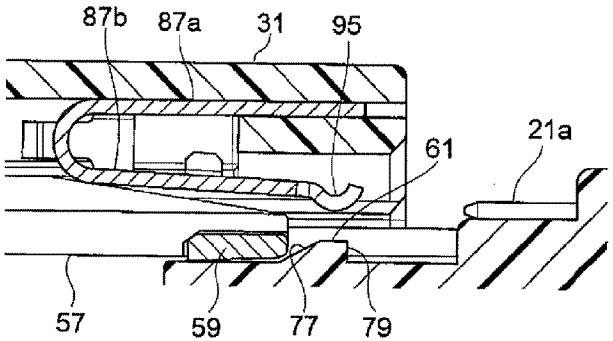

Next, as shown in FIG. 6B, the locked portion 59 of the lock arm 23 rides on the lock portion 61 along the inclined surface 77 of the lock portion 61 protruding from the hood portion 33. Thereby, the two arm bodies 57 of the lock arm 23 are deformed around the base end portions of the two arm bodies 57, displaced upward, and enter the operating space 37 through the window portion 41. As a result, in the one first terminal 19*a*, the second piece portion 87*b* is pushed up and the spring member 89 is compressed and deformed, and at the same time, the contact portion 95 formed in the second piece 87*b* is displaced in a direction away from the one second terminal 21*a* entered into the operating space 37.

Figure 6C:
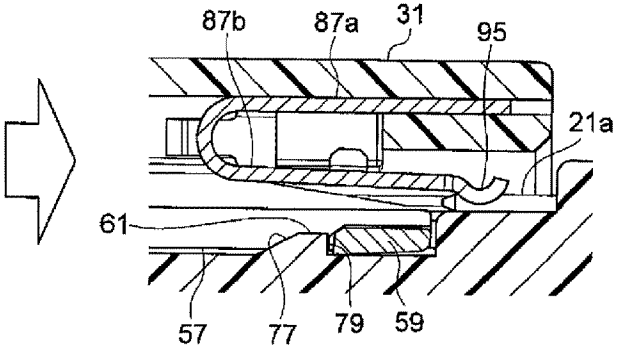

Subsequently, as shown in FIG. 6C, when both the housings 15 and 17 reach the fitting position (normal fitting position), the pair of arm bodies 57 elastically return, and the locked portion 59 is engaged with the locking surface 79 over the lock portion 61. As a result, in the one first terminal

19*a*, the second piece 87*b* elastically returns, and the contact portion 95 comes into contact with the one second terminals 21*a*.

Herein, the other first terminal 19*b* is configured such that the other second terminal 19*b* is connected to the contact portion (not shown) when both the housings 15 and 17 reach the fitting position. Therefore, while the one first terminal 19*a* comes into contact with the one second terminal 21*a*, and the other first terminal 19*b* comes into contact with the other second terminal 21*b*. Thus, the pair of second terminals 21*a* and 21*b* are short-circuited via the pair of first terminals 19*a* and 19*b* electrically connected by the electric wire 99, and the detection signal is output from the detection circuit, and thereby it is detected that the two housings 15 and 17 have reached the fitted state.

In order to detect the fitted state when both the housings 15 and 17 reach the fitting position, it is necessary that the pair of second terminals 21*a* and 21*b* are short-circuited when the two housings 15 and 17 reach the fitting position, that is, the pair of second terminals 21*a* and 21*b* are not short-circuited until both the housings 15 and 17 reach the fitting portion. However, water may enter the connector from the outside when both the housings 15 and 17 are fitted, and dew condensation may occur in the housing or water may enter the housing in a state where both the two housings 15 and 17 are separated. In such a case, when a water droplet or the like is interposed between the pair of second terminals 21*a* and 21*b*, the pair of second terminals 21*a* and 21*b* are short-circuited before the housings 15 and 17 reach the fitted state. As a result, there is a possibility of erroneous detection that both the housings 15 and 17 have reached the fitted state even through both the housings 15 and 17 are in a half fitted state.

In contrast, in the embodiment of the present invention, since the pair of first terminals 19*a* and 19*b* supported by the first housing 15 are disposed at predetermined positions away from each other. For this reason, in the second housing 17, one of the pair of second terminals 21*a* and 21*b* is disposed outside the hood portion 33, and the other thereof is disposed inside the hood portion 33. Thus, since the creepage distance between the pair of second terminals 21*a* and 21*b* can be increased, a short circuit between the second terminals 21*a* and 21*b* can be prevented even if a water droplet or the like is interposed between the pair of second terminals 21*a* and 21*b*, and the reliability of the fitting detection of the connector can be improved.

Further, in the embodiment of the present invention, in a case that both the housing 15 and 17 are fitted, the other second terminal is disposed within the range of the waterproof structure covered by the housing main body 25 and the hood portion 33 in which the gap between the housing main body 25 and the hood portion 33 is sealed. Thereby, even if the connector is exposed to rainwater and so on and rainwater is entered into the connecter, the second terminal 21*b* can be prevented from getting water. Therefore, the occurrence of a short circuit between the second terminals 21*a* and 21*b* can be more reliably prevented, and the reliability of the fitting detection of the connector can be further improved.

Further, in the embodiment of the present invention, when the housings 15 and 17 reach the fitted state, the locked portion 59 of the lock arm 23 of the first housing 15 is locked over the lock portion 61 of the second housing 17, and the contact portion 95 of the one first terminal 19*a* is configured to be in contact with the one second terminal 21*a* in conjunction with the displacement of the lock arm 23 at this time. Therefore, the one first terminal 19*a* can be brought into contact with the one second terminal 21*a* at the timing when two housings 15 and 17 are fitted. Thus, accuracy of the fitting detection in the connector can be improved. In this case, the one first terminal 19*a* and the one second terminal 21*a* are arranged within the range of the non-waterproof structure, but since the other second terminal 21*b* is disposed within the range of the waterproof structure as described above, erroneous detection due to a short circuit between the second terminals 21*a* and 21*b* does not occur. Therefore, according to the embodiment of the present invention, it is possible to prevent erroneous detection due to a short circuit between the second terminals 21*a* and 21*b* and improve the fitting detection accuracy of the connector.

Further, in the embodiment of the present invention, since the pair of first terminals 19*a* and 19*b* are electrically connected by the electric wire 99, the pair of first terminals 19*a* and 19*b* can be made conductive by a simple operation, and the manufacturing cost can be reduced because the component cost can be reduced. Further, by using the electric wire 99 in this manner, the pair of first terminals 19*a* and 19*b* can be freely conducted regardless of the arrangement of the first terminals 19*a* and 19*b* and the distance between the first terminals 19*a* and 19*b*, so that the degree of freedom in design of the connector can be improved.

Further, in the embodiment of the present invention, since the connecting portion 91 connected to the female terminal 49 is provided at the one first terminal 19*a*, the position of the female terminal 49 can be freely set by changing the shape of the connecting portion 91, and the degree of freedom in design can be improved. Further, since the connecting portion 91 is not inserted into the first housing 15 and is fitted into and engaged with the first housing 15, it is easy to assemble the connecting portion 91, and the manufacturing cost can be reduced.

While the present invention has been described with reference to exemplary embodiments, it is to be understood that the invention is not limited to the disclosed exemplary embodiments. The present invention may, of course, be modified in design without departing from the scope of the present invention.

For example, in the present embodiment, the other first terminal 19*a* and the other second terminal 21*a* are disposed within the range of the waterproof structure covered by the housing main body 25 and the hood portion 33 in which the gap between them is sealed. However, the first terminals 19*a* and 19*b* and the second terminals 21*a* and 21*b* may be provided so as to be spaced apart from each other with a set distance so that the pair of second terminals 21*a* and 21*b* are disposed with a space that is not short-circuited by a water droplet or the like.

In the present embodiment, the pair of first terminals 19*a* and 19*b* are electrically connected via the electric wire 99. Alternatively, in addition to this, the pair of first terminals 19*a* and 19*b* may be electrically connected to each other via a desired conductor (for example, a metal conductor insert-molded in the first housing 15). In this case, the pair of first terminals 19*a* and 19*b* may be formed integrally with each other by a conductor, or may be connected by a conductor in a state of being separated from each other.

In the present embodiment, female terminals are used as the first terminals 19*a* and 19*b*, and male terminals are used as the second terminals 21*a* and 21*b*. However, male terminals may be used as the first terminals 19*a* and 19*b*, and female terminals may be used as the second terminals 21*a* and 21*b*.

In the present embodiment, the lock arm 23 is cantilevered by the first housing 15. However, the support structure of the lock arm 23 is not limited thereto. In short, it is possible to adopt for example a double support structure supporting any two portions of the lock arm 23 by the first housing 15 if the locked portion 59 of the lock arm 23 has an elastically deformable portion that abuts on the spring member 89 of the first terminal 19*a* and displace the contact portion 95 in a direction away from the one second terminal 21*a* based on the displacement when the locker portion 59 of the lock arm 23 is moved over the lock portion 61 of the second housing 17.

The features of the connecter fitting detection structure and connector according to the embodiment of the present invention described above will be briefly summarized and listed in the following items (1) to (4).

(1) A connector fitting detection structure comprising:

a pair of connectors (11, 13) formed to be capable of fitting to each other, wherein one connecter (11) of the pair of connectors including:

a first housing (15), a lock arm (23) which is elastically deformed and supported by the first housing (15), a locked portion (59) provided in the lock arm (23), and a pair of first terminals (19*a*, 19*b*) supported by the first housing (15) in a state that the terminals are electrically connected to each other, the other connector (13) of the pair of connectors including:

a second housing (17):

a lock portion (61) provided in the second housing (17), and a pair of second terminals (21*a*, 21*b*) supported by the second housing (17), wherein when the pair of connectors (11, 13) are fitted, the locked portion (59) of the one connector (11) is moved over the lock portion (61) of the other connector (13) and engaged with the lock portion (61) thereof, the pair of first terminals (19*a*, 19*b*) and the pair of second terminals (21*a*, 21*b*) are arranged at positions electrically connectable to each other when the pair of connectors are fitted, when conduction between the pair of second terminals (21*a*, 21*b*) is detected by the pair of first terminals (19*a*, 19*b*), it is detected that the pair of connectors (11, 13) are fitted, one (19*a*) of the pair of first terminals has a spring member (89), one end of the spring member (89) is a fixed end supported by the first housing (15), and the other end thereof is a free end in which a contact portion (95) is formed so as to come into contact with one of the pair of second terminals, the other (19*b*) of the pair of first terminals is arranged to come into contact with the other of the pair of second terminals and to be separated from the one (11) of the pair of first terminals when the pair of connectors are fitted, and the lock arm (23) is configured such that when the locked portion (59) is moved over the lock portion (23), the lock arm (61) is displaced to abut on the spring member (89), and the contact portion (95) is displaced in a direction away from the one (21*a*) of the pair of second terminals, and when the locked portion is engaged with the lock portion over the lock portion, the contact portion comes into contact with the one (21*a*) of the pair of second terminals.

(2) The connector fitting detection structure according to the above item (1), wherein the pair of first terminals (19*a*, 19*b*) are electrically connected to each other by an electric wire (99).

(3) The connector fitting detection structure according to the above item (1) or (2), wherein the first housing (15) has a first tubular portion (25) which holds the other of the pair of first terminals therein, the second housing (17) has a second tubular portion (33) which holds the other of the pair of second terminals therein and into which the first tubular portion is inserted, and an annular elastic member (83) is arranged in an outer peripheral surface of the first tubular portion (25) so as to seal a gap between the outer peripheral surface of the first tubular portion (25) and an inner peripheral surface of the second tubular portion (33).

(4)

A connector comprising:

a housing (15) formed to be capable fitting with a mating housing (17); and a pair of terminals (19*a*, 19*b*) which are supported by the housing in a state that the pair of terminals are electrically connected to each other and are electrically connected to a pair of detection terminals (21*a*, 21*b*) supported by the mating housing when the housing is fitted to the mating housing, wherein the housing (15) is configured such that a locked portion (59) provided in a lock arm (23) elastically deformable supported by the housing is moved over a lock portion (61) provided in the mating housing and engaged with the lock portion when the housing is fitted to the mating housing, one (19*a*) of the pair of terminals has a spring member (89), one end of the spring member is a fixed end supported by the housing, and the other end thereof is a free end in which a contact portion is formed so as to come into contact with one (21*a*) of the pair of detection terminals, the other (19*b*) of the pair of terminals is arranged to come into contact with the other of the pair of detection terminals and to be separated from the one (11) of the pair of terminals when the housing is fitted to the mating housing, the lock arm (23) is configured such that when the locked portion (59) is moved over the lock portion (61), the lock arm is displaced to abut on the spring member (89), and the contact portion (95) is displaced in a direction away from the one (21*a*) of the pair of detection terminals, and when the locked portion is engaged with the lock portion over the lock portion, the contact portion (95) comes into contact with the one (21*a*) of the pair of detection terminals.

This application is based on Japanese Patent Application number 2016-136323, filed Jul. 8, 2016, the contents of which are incorporated herein by reference.

INDUSTRIAL APPLICABILITY

According to the connector of the present invention, it is possible to improve the reliability of the fitting detection of the connector. The present invention having this effect is useful for a connector fitting detection structure and a connector.

The invention claimed is:

1. A connector fitting detection structure comprising:

a pair of connectors formed to be capable of fitting to each other;

one connecter of the pair of connectors including:

a first housing;

a lock arm which is elastically deformed and supported by the first housing;

a locked portion provided in the lock arm; and a pair of first terminals being independent members each other, disposed at positions different from each other across a wall body constructing the first housing, and supported by the first housing in a state that the terminals are electrically connected to each other, the other connector of the pair of connectors including:

a second housing;

a lock portion provided in the second housing; and a pair of second terminals supported by the second housing, wherein when the pair of connectors are fitted, the locked portion of the one connector is moved over the lock portion of the other connector and engaged with the lock portion thereof, wherein the pair of first terminals and the pair of second terminals are arranged at positions electrically connectable to each other when the pair of connectors are fitted, wherein when conduction between the pair of second terminals is detected by the pair of first terminals, it is detected that the pair of connectors are fitted, wherein one of the pair of first terminals has a spring member, wherein one end of the spring member is a fixed end supported by the first housing, and the other end thereof is a free end in which a contact portion is formed so as to come into contact with one of the pair of second terminals, wherein the other of the pair of first terminals comes into contact with the other of the pair of second terminals when the pair of connectors are fitted, and wherein the lock arm is configured such that when the locked portion is moved over the lock portion, the lock arm is displaced to abut on the spring member, and the contact portion is displaced in a direction away from the one of the pair of second terminals, and when the locked portion is engaged with the lock portion over the lock portion, the contact portion comes into contact with the one of the pair of second terminals.

2. The connector fitting detection structure according to claim 1, wherein the pair of first terminals are electrically connected to each other by an electric wire.

3. The connector fitting detection structure according to claim 1, wherein the first housing has a first tubular portion which holds the other of the pair of first terminals therein, wherein the second housing has a second tubular portion which holds the other of the pair of second terminals therein and into which the first tubular portion is inserted, and wherein an annular elastic member is arranged in an outer peripheral surface of the first tubular portion so as to seal a gap between the outer peripheral surface of the first tubular portion and an inner peripheral surface of the second tubular portion.

4. A connector comprising:

a housing formed to be capable fitting with a mating housing; and a pair of terminals which are independent members each other, disposed at positions different from each other across a wall body constructing the housing, and supported by the housing in a state that the pair of terminals are electrically connected to each other and are electrically connected to a pair of detection terminals supported by the mating housing when the housing is fitted to the mating housing, wherein the housing is configured such that a locked portion provided in a lock arm elastically deformable supported by the housing is moved over a lock portion provided in the mating housing and engaged with the lock portion when the housing is fitted to the mating housing, wherein one of the pair of terminals has a spring member, wherein one end of the spring member is a fixed end supported by the housing, and the other end thereof is a free end in which a contact portion is formed so as to come into contact with one of the pair of detection terminals, wherein the other of the pair of terminals comes into contact with the other of the pair of detection terminals when the housing is fitted to the mating housing, and wherein the lock arm is configured such that when the locked portion is moved over the lock portion, the lock arm is displaced to abut on the spring member, and the contact portion is displaced in a direction away from the one of the pair of detection terminals, and when the locked portion is engaged with the lock portion over the lock portion, the contact portion comes into contact with the one of the pair of detection terminals.

* * * * *